United States Patent [19]

MacArthur et al.

[11] Patent Number: 4,534,320

[45] Date of Patent: Aug. 13, 1985

[54] METHOD FOR DETERMINING THE AMOUNT OF DISSOLVED OXYGEN FROM ABOVE AND BELOW WATER LEVEL AIR LEAKAGE IN A STEAM POWER PLANT

[75] Inventors: Alexander D. MacArthur, Export; Harry J. Everett, West Mifflin, both of Pa.

[73] Assignee: Westinghouse Electric Corp., Pittsburgh, Pa.

[21] Appl. No.: 585,063

[22] Filed: Mar. 1, 1984

[51] Int. Cl.[3] ..... F22D 7/00

[52] U.S. Cl. ..... 122/406 R; 60/646; 60/657; 62/195; 73/196; 165/11 R

[58] Field of Search ..... 122/406 R; 62/195; 165/11 R; 60/646, 657; 73/195, 196, 198

[56] References Cited

U.S. PATENT DOCUMENTS

| | | | |
|---|---|---|---|
| 1,750,035 | 3/1930 | Brown | 60/657 |
| 2,364,789 | 12/1944 | Haywood | 73/195 |
| 3,151,461 | 10/1964 | Sebald et al. | 60/657 |
| 4,178,801 | 12/1979 | Cassell et al. | 73/195 |
| 4,275,447 | 6/1981 | Ruiz | 60/646 |
| 4,282,715 | 8/1981 | Edwall et al. | 60/646 |
| 4,345,438 | 8/1982 | Labbe et al. | 60/657 |
| 4,365,476 | 12/1982 | Masuda et al. | 60/657 |
| 4,472,355 | 9/1984 | Hickam et al. | 60/657 |

FOREIGN PATENT DOCUMENTS

| | | | |
|---|---|---|---|
| 65883 | 5/1980 | Japan | 60/646 |

*Primary Examiner*—Edward G. Favors
*Assistant Examiner*—Steven E. Warner
*Attorney, Agent, or Firm*—Daniel C. Abeles

[57] ABSTRACT

A method for determining the amount of dissolved oxygen in the aqueous medium from a steam generator system that results from air leakage into the system above the water level in a condensor hotwell and that which results from air leakage below the water level in the condensor. Intentional injection of air above water level and intentional injection of air below water level are effected and resultant dissolved oxygen contents measured. The air leakage rate and dissolved oxygen contents at steady state operation are also measured. From these measurements, the amount of dissolved oxygen resulting from above and below water level are determined mathematically or graphically.

7 Claims, 2 Drawing Figures

METHOD FOR DETERMINING THE AMOUNT OF DISSOLVED OXYGEN FROM ABOVE AND BELOW WATER LEVEL AIR LEAKAGE IN A STEAM POWER PLANT

BACKGROUND OF THE INVENTION

In various condensor systems of power plants, an aqueous medium is recirculated that eventually picks up unwanted oxygen, the oxygen becoming dissolved in the aqueous medium. The presence of dissolved oxygen in such an aqueous medium has a corrosive effect on the downstream components of the system, such as feedwater heaters and steam generators.

Often, oxygen finds its way into the aqueous medium through leakage into the condensor, while further oxygen finds its way into the system at a later stage in the circulating loop. In the condensor, a hotwell or water reservoir is present. Oxygen which enters the aqueous medium before collection of the aqueous medium in the hotwell is considered as oxygen entering above the water level. Oxygen which is entering the aqueous medium below the liquid level in the hotwell and in the lines up to the circulating pumps downstream from the condensor is considered as oxygen entering below the water level.

In such systems, absorption of oxygen into the aqueous medium may occur due to leakage into the system above the water level or leakage below the water level. In existing systems, the need to repair or replace various components due to air leakage, and oxygen absorption therefrom, will depend upon the quantity of oxygen that is being absorbed at a location either above or below the water level in the condensor. For example, a large air leakage into the condensor above the water level, while being apparent, may in fact only result in a minor amount of dissolved oxygen in the aqueous medium. On the other hand, a small air leakage into the system below the water level may be a primary contributing factor to the amount of dissolved oxygen in the aqueous medium.

It is an object of the present invention to provide a method to determine the magnitude of the absorption of oxygen into the aqueous medium from air leakage above the water level relative to the magnitude of the absorption of oxygen into the aqueous medium from air leakage below the water level of a condensate system of a power plant.

SUMMARY OF THE INVENTION

A method is provided for determining the amount of dissolved oxygen in the aqueous medium from a steam and condensate system that results from air leakage into the condensor above the water level in the condensor and from air leakage into the condensor and lines to recirculation pumps below the water level in the condensor. The method comprises injecting air into the condensor, at a known flow rate, above the water level in the condensor hotwell, and measuring the concentration of dissolved oxygen in the water resulting from that injection. A second known volumetric flow rate of air is injected into the condensor system below the water level, and the amount of dissolved oxygen in the aqueous medium resulting from that injection is then measured. The actual amount of normal air leakage and of dissolved oxygen in the water from the condensor resulting from normal leakage, and without any intentional injection of air into the system, are then measured.

By using the aforementioned measurements, a determination is made of the amount of dissolved oxygen in the water resulting from leakage of air into the system above the water level in the condensor and that amount resulting from leakage into the system below the water level in the condensor. The determination may be made mathematically or graphically. In a graphical determination, a plurality of first known injections and a plurality of second known injections are made.

DETAILED DESCRIPTION

Figure 1:
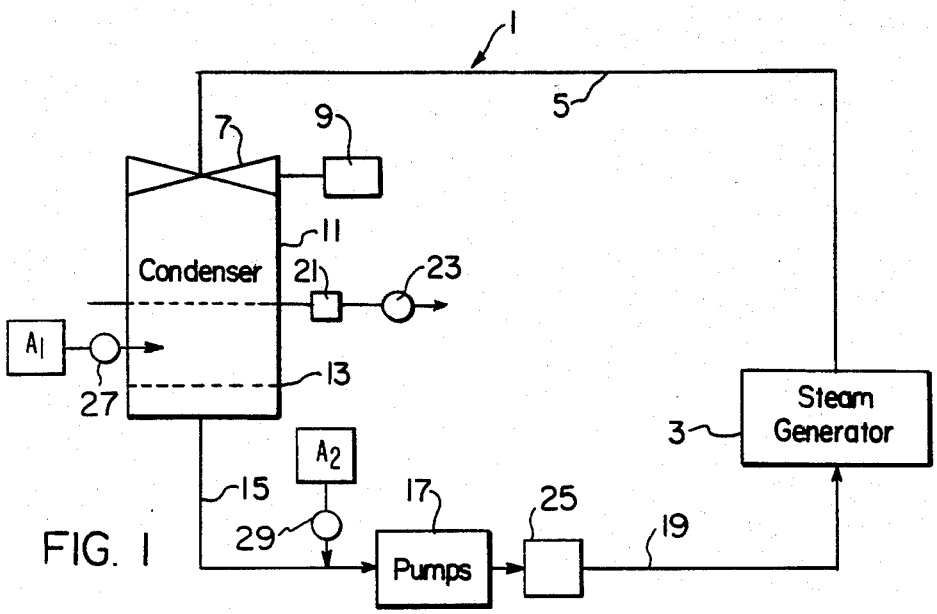
FIG. 1 schematically illustrates a power plant system containing a condensor wherein the present method is usable to determine above water level and below water level oxygen absorption into the system.

Referring now to FIG. 1, there is schematically illustrated a steam plant 1 having a condensor system and means for recirculating an aqueous medium therethrough. The plant 1 includes a steam generator 3, the steam generator using heat, such as from the coolant of a pressurized water nuclear reactor, to generate steam. The steam through line 5 drives a turbine-generator set 7 which operates a generator 9 to produce electricity. Vitiated steam from the turbine is condensed in a condensor 11 and condensate collects in hotwell 13. Condensate from the condensor is passed through line 15 to recirculating pumps 17, and the pumps recirculate the aqueous medium through a feedwater heating system (not shown) and through line 19 back to the steam generator.

Oxygen is often absorbed in the steam generator system, either above the water level in the condensor or below the water level of the condensor and before the pumps, i.e. up to the suction side of those pumps.

Leakage air into the condensor system is removed from the condensor by a pump, such as an ejector pump 21. Under steady state conditions, measurement by a flowmeter 23, of the rate of removal of air from the condensor provides an indication of the total leakage rate of air into the system both above and below the water level in the condensor hotwell.

A determination of the oxygen content in the water from a condensor resulting from above water level air inleakage and from below water level air inleakage is accomplished by establishing a relationship between controlled injections of air and the resulting measurements of oxygen content of the water.

In each case, the relationship is in the form of $y=ax+b$, where y is the concentration of dissolved oxygen in the water, and x is the rate of volumetric addition of air. The constants a and b will vary in each case. A direct relationship between the two cases can be established by solving the two equations from the two cases, namely $y_1=a_1x_1+b_1$ and $y_2=a_2x_2+b_2$, simultaneously.

Each of these equations represents the relationship between the intentional injection of oxygen, either above or below the condensor water level, in addition to the unintentional oxygen leakage. The unintentional oxygen leakage can then be determined by simultaneous solution of these two equations. In other words, the actual leakage can be derived as some combination of portions of these two functions. With zero leakage, the dissolved oxygen is zero. By making the offset constant, b, of one of these equations, namely the equation representing the leakage of oxygen above the water level, equal to zero, this equation becomes $y_1=a_1x_1$, so that this function meets the initial conditions. Since the other equation was derived from data which included the total actual leakage, it satisfies the initial conditions which establish the total leakage value. By determining the point where these two functions are equal, the contributions to dissolved oxygen from the two leakage sources can be determined. At this point, $x_1=x_2$ and $y_1=y_2$ and the values of the two equations are equal. With the two equations being equal, $a_1x_1=a_2x_2+b_2$ from which $x_1$ can be derived as a function of the constants $a_1$, $a_2$ and $b_2$, which in turn can be derived from the plot of data. $x_1$ then equals the amount of leakage from above the water level and the measured leakage minus $x_1$ equals the amount of leakage from below the water level. The proportion of dissolved oxygen from each source can then be derived by plugging the leakage numbers into the appropriate equation.

The same conclusion can be established graphically. Solubility of oxygen in water will be slight if air is admitted into the condensor above the water level in the hotwell, since the same is rapidly removed from the system conventionally by vacuum exhaustion, as by the pump 21.

Figure 2:
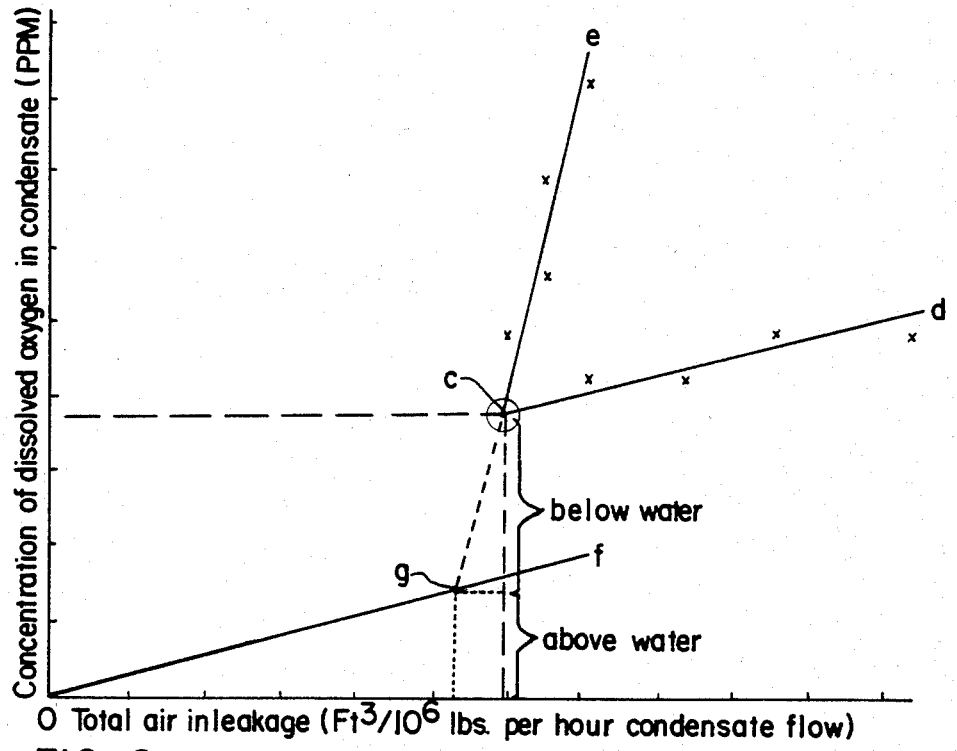
FIG. 2 illustrates a graph for graphically determining the oxygen content resulting from above water air leakage and below water air leakage, according to the method of the present invention.

The solubility of oxygen, from air, in the condensate in the condensor, is assumed to be zero when the system contains no air flow above the water level, i.e. is not subject to any air inleakage. As illustrated in FIG. 2, the origin would represent the point of zero air admission and the zero concentration dissolved oxygen.

The measurement of the actual oxygen content of the water from the condensor under normal operating conditions, and at steady state air inleakage, such as by an oxygen analyzer 25, is used to define point c on the graph.

Air $A_1$ is injected, at a precisely measured volumetric flow rate, or plurality of known flowrates, such as through a flowmeter 27, into the steam space of a condensor above the water level in the hotwell and the dissolved oxygen content of the condensate is measured, such as by an oxygen analyzer 25. An increase in the injection flow rate is then made and the measurement repeated. After a plurality of such injections and measurements, a plot is made on the graph, corresponding to line c-d, which represents the best linear fit to the data.

Air $A_2$ is next injected, at a precisely measured flow rate, or plurality of known flowrates, such as through a flowmeter 29, into the condensor below the water level, at a point between the water level and the suction side of the associated condensate pumps. The dissolved oxygen content of the condensate is measured, such as by oxygen analyzer 25. An increase in the injection flow rate is then made and the measurement repeated. After a plurality of such injections and measurements, a plot is made on the graph, corresponded to line c-e.

Once the slope of line c-d has been determined, this line may be displaced as shown on the graph to produce line o-f. The linear relationship for below water air inleakage will produce a slope considerably steeper than that of line c-d, due to greater effect caused by such leakage on oxygen solubility relative to above water inleakage.

By extending line c-e to below the point c along the established slope, this line will intersect line o-f to provide point g of the graph. This point identifies the unique simultaneous solution c to the equations representing unintentional air inleakage below and above water level, thus fixing the contribution of each area to the total oxygen content in the condensate.

A vertical line dropped from point g to the abscissa, the x-coordinate line representing air inleakage, divides the total air inleakage into the portions entering above water level (the portion left of the vertical line), and below water level (the portion to the right of the same line and extending to a vertical line dropped from point c to the abscissa). A horizontal line extended from point g to the y-ordinate line represents the dissolved oxygen concentration. This line divides the amount of dissolved oxygen in the condensate into that amount due to air inleakage above water level (below the horizontal line to the abscissa) and below water level (above the same horizontal line to point c).

The present method thus provides a means for determining the amount of dissolved oxygen in the aqueous medium due to above water air inleakage into the condensor system, and the amount of dissolved oxygen in the aqueous medium due to below water air inleakage. The operator can thus determine which problem of leakage should be corrected in order to best reduce the absorption of oxygen into the aqueous medium.

What is claimed is:

1. A method for determining the amount of dissolved oxygen in the aqueous medium of a steam plant containing a condensor system including a condensor and recirculating pumps, the condensor having a hotwell, resulting from air leakage into the condensor above the water level in said hotwell and from air leakage below the water level in said hotwell and up to the suction side of the recirculating pumps, comprising:

injecting a first known volumetric flow rate of air into the condensor system above the water level in the condensor hotwell;

measuring the amount of dissolved oxygen in the water resulting from the injection of said first known flow rate of air;

injecting a second known volumetric flow rate of air into the condensor system, at a location below the water level in the condensor hotwell and up to the suction side of the recirculating pumps;

measuring the amount of dissolved oxygen in the water resulting from the injection of said second known flow rate of air;

measuring the actual amount of dissolved oxygen in the water from the condensor system resulting from leakage of air into said condensor system, without any intentional injection of air;

measuring the actual total volumetric flow rate of air leakage into the system without any intentional injection of air; and determining from said four measurements and said two injection rates the amount of said dissolved oxygen in the water resulting from leakage into the system above the water level in the condensor and that amount resulting from leakage into the system below the water level in the condensor.

2. The method defined in claim 1 including injecting a plurality of first known volumetric flow rates of air, and injecting a plurality of second known volumetric flow rates of air; measuring the amount of dissolved oxygen resulting from each of said plurality of injections; and determining said amount of dissolved oxygen resulting from leakage above the water level and said amount resulting from leakage below the water level, from said plurality of injections.

3. The method defined in claim 1 wherein said step of measuring the total leakage of air into the system comprises the steps of: evacuating from the system the leakage air and, under steady state conditions, measuring the volumetric flow rate of the evacuated leakage air.

4. The method as defined in claim 3 wherein said leakage air is evacuated from the condensor.

5. The method as defined in claim 2 wherein said determining step comprises graphically determining the amount of dissolved oxygen due to air leakage above the water level and the amount due to leakage below the water level by plotting on an x-y graph, as a function of dissolved oxygen on one axis and air leakage on the other axis, a first point, representative of the measured total dissolved oxygen and total air leakage under steady state conditions with no intentional leakage, plotting on the same graph the data obtained from the measurements of dissolved oxygen for each of said plurality of first and second known volumetric flow rates of air, drawing first and second linear functions which best fit the plotted data points from said first and second plurality of measurements, respectively, which linear straight line functions will both pass through said first point, shifting the straight line associated with the data from said first measurements while maintaining its slope constant until it passes through the origin of the graph which represents zero dissolved oxygen and zero air leakage volumetric flow rate and such that it intersects the linear extension of the second straight line function at a second point, determining from the scale of the dissolved oxygen axis the dissolved oxygen value represented by said second point as the dissolved oxygen attributable to leakage above the water level in the condensor, and determining from the dissolved oxygen scale the difference between the dissolved oxygen value of said second point and that of said first point as the amount of dissolved oxygen attributable to leakage below the water level in the condensor.

6. The method as defined in claim 5 including the steps of determining from the scale of the air leakage volumetric flow rate axis the rate represented by said second point as the value of the rate of air leakage above the water level and determining from the air leakage volumetric flow rate axis the difference between the rate represented by said second point and that represented by said first point as the volumetric flow rate of air leakage below the water level in the condensor.

7. The method as defined in claim 1 wherein said determining step comprises the steps of solving the equations:

$$y_1 = a_1 x_1$$

$$y_2 = a_2 x_2 + b_2$$

where:

$y_1$ = dissolved oxygen due to leakage above water level;

$y_2$ = dissolved oxygen due to leakage below water level;

$a_1$ = slope of first function calculated as the rate of change in dissolved oxygen resulting from said first air injection;

$a_2$ = slope of second function calculated as the rate of change in dissolved oxygen resulting from said second air injection; and $b_2$ = offset constant of second function determined from $a_2$ and measured values of dissolved oxygen and volumetric flow rate of leakage without intentional leakage;

for conditions wherein $x_1 = x_2 = x$ and $y_1 = y_2 = y$ so that y = dissolved oxygen due to leakage above the water level, x = air leakage above water level, and the total dissolved oxygen − y and the total unintentional air leakage − x equal the dissolved oxygen due to leakage below water level and the rate of air leakage below water level, respectively.

* * * * *